US006665906B2

(12) United States Patent
Li

(10) Patent No.: US 6,665,906 B2
(45) Date of Patent: Dec. 23, 2003

(54) HINGE

(76) Inventor: Jr-Hua Li, No. 50-1, Tieh-Lu Lane, Ping-Tung City, Ping-Tung Hsien (TW)

( * ) Notice: Subject to any disclaimer, the term of this patent is extended or adjusted under 35 U.S.C. 154(b) by 0 days.

(21) Appl. No.: 10/139,350

(22) Filed: May 7, 2002

(65) Prior Publication Data

US 2003/0208881 A1 Nov. 13, 2003

(51) Int. Cl.[7] ..... E05D 11/10
(52) U.S. Cl. ..... 16/330; 16/303; 16/321
(58) Field of Search ..... 16/303, 321, 297, 16/298, 299, 330; 403/83, 84; 192/46, 69.81; 211/149, 150

(56) References Cited

U.S. PATENT DOCUMENTS 5,125,131 A * 6/1992 Leblanc ..... 16/330
5,774,938 A * 7/1998 Kent et al. ..... 16/332
5,799,371 A * 9/1998 Lin ..... 16/330
6,070,298 A * 6/2000 Sorimachi ..... 16/330
6,178,597 B1 * 1/2001 Suzuki et al. ..... 16/330

* cited by examiner

*Primary Examiner*—Anthony Knight
*Assistant Examiner*—Michael J. Kyle
(74) *Attorney, Agent, or Firm*—Birch, Stewart, Kolasch & Birch, LLP

(57) ABSTRACT

A hinge consists of a movable upper leaf, a lower leaf, a transmission and a pair of caps for anchoring a panel of a table or a storage rack or a merchandise shelf fastened to the hinge on an extending or folding position. The transmission connects the movable upper leaf and the lower leaf to make the movable upper leaf turnable. The transmission has a retaining mechanism to engage with the movable upper leaf to allow the panel and the upper leaf extending and anchoring within allowable angles, or to disengage with the upper leaf to move the panel to a folding position.

1 Claim, 13 Drawing Sheets

HINGE

FIELD OF THE INVENTION

The present invention relates to a hinge and particularly to a hinge allowing to be turned and anchored on selected angles.

BACKGROUND OF THE INVENTION

The commonly used tables, racks or shelves are mostly designed for use in a fixed assembly manner. While such type of design may serve some practical purposes, it also creates many problems, notably:

1. When conventional fixed tables or racks are being carried or transported to where they are required, the door panels, table tops or racks have to be fixedly nailed and fastened for use. The finished and fixed tables or racks often occupy a large amount of space and are difficult to move and transport, and create a lot of storing inconveniences and incur additional handling time and costs.
2. The fixed tables and racks tend to get damages easily on table top surfaces or rack structures during moving and transportation.
3. Once the tables or racks are fixedly assembled, they have limited spaces for holding goods and are less flexible to use or deploy.

SUMMARY OF THE INVENTION

In view of aforesaid disadvantages, the primary object of the invention is to provide an improve hinge for achieving the following advantages:

1. The hinge of the invention provides a position anchoring function to enable a table or a storage rack or merchandise display shelf be extended for use or folded to a small space for storing depending on requirements. The hinge of the invention has a driving ratchet wheel coupling with an upper leaf and a lower leaf and a transmission means engaging with the driving ratchet wheel such that the upper leaf may be turned and a retainer may anchor the upper leaf on a selected angle (between 0 and 120 degrees). When the upper leaf is turned beyond the upper anchoring limit, a jutting key is moved to push and disengage the retainer to enable the upper leaf be moved in a folding condition.
2. The upper leaf of the hinge may be fastened to a table top, a storage rack or a merchandise shelf to extend or fold against the lower leaf. When the upper leaf is extended on a selected angle, the jutting keys on two ends of the ratchet wheel and the retainers in rotary elements located in driven ratchet wheels form a brake relationship to produce a secured anchoring so that the table top or storage rack may be extended and latched on a desired position for use.
3. Table tops, storage racks or merchandise shelves adopt the hinge of the invention can be extended at selected angles or folded to a small space for storing, thus have greater flexibility and wider applications.

The foregoing, as well as additional objects, features and advantages of the invention will be more readily apparent from the following detailed description, which proceeds with reference to the accompanying drawings.

DESCRIPTION OF THE PREFERRED EMBODIMENTS

Figure 1:
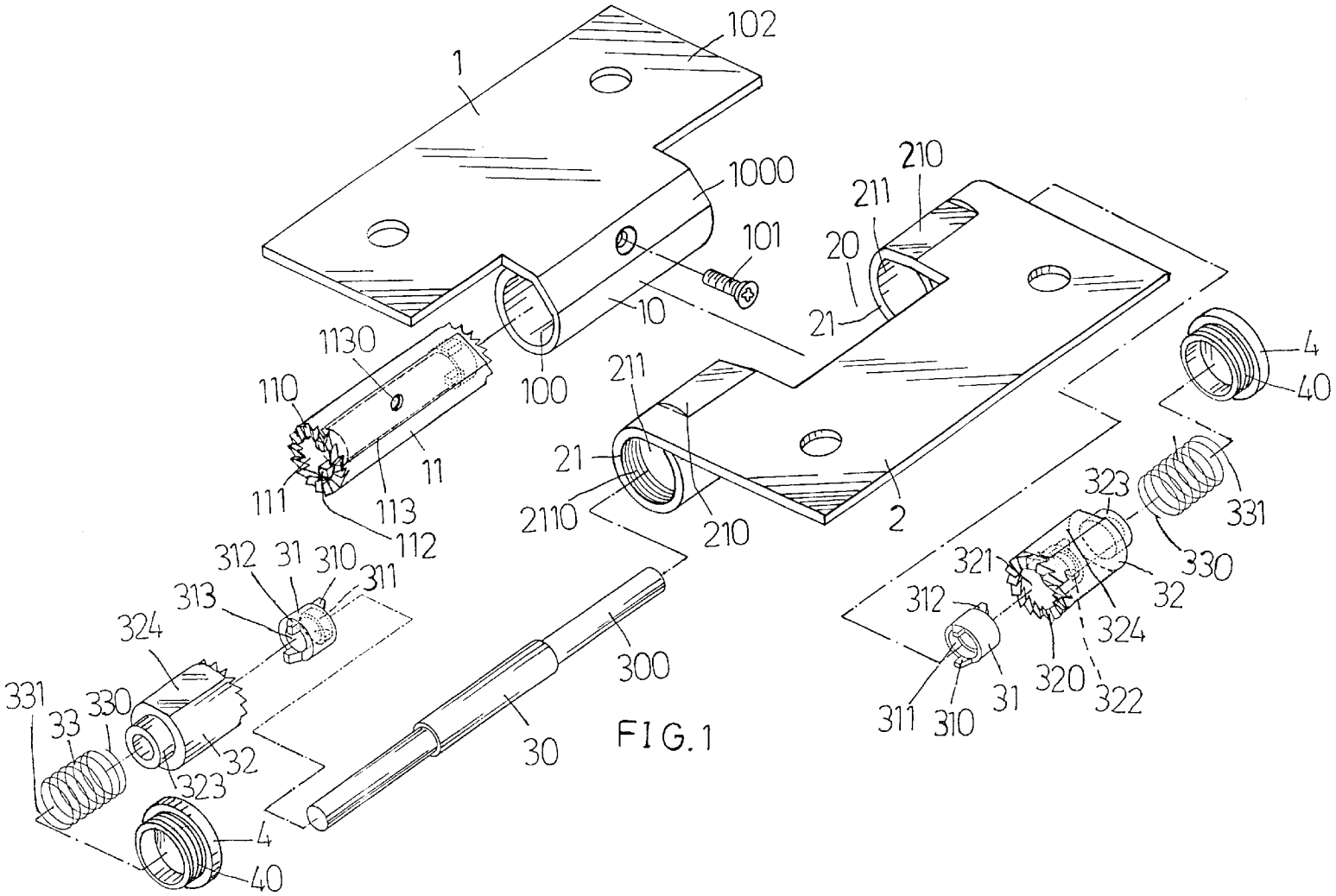
FIG. 1 is an exploded view of the invention.
Figure 2:
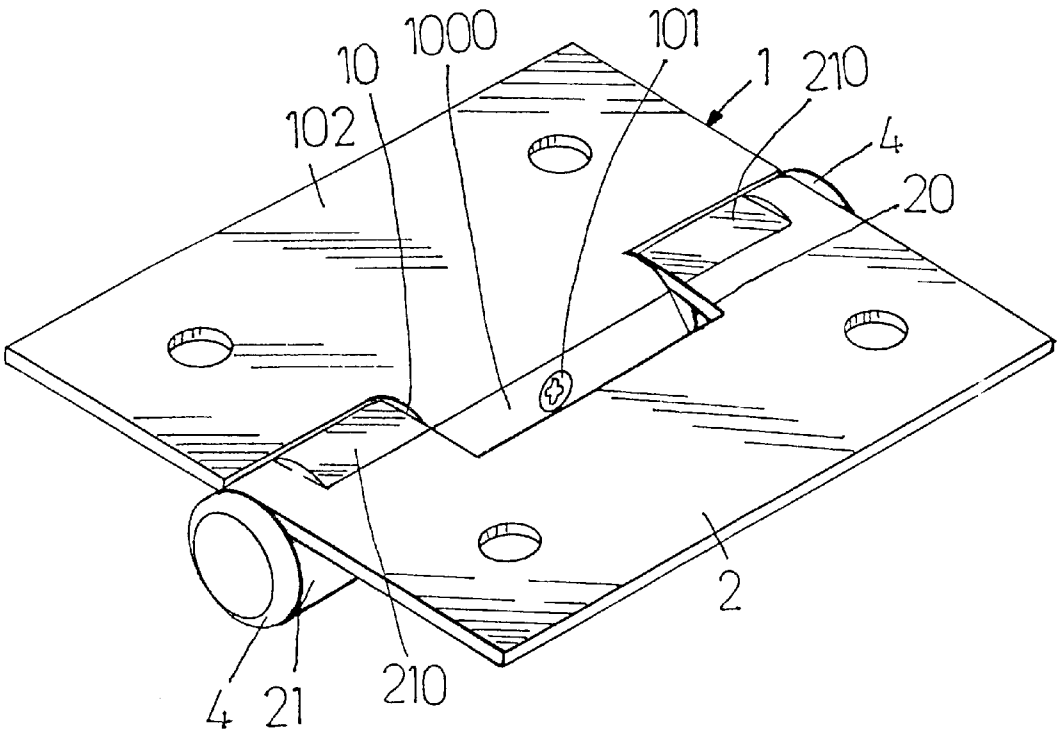
FIG. 2 is a perspective view of the invention.
Figure 3:
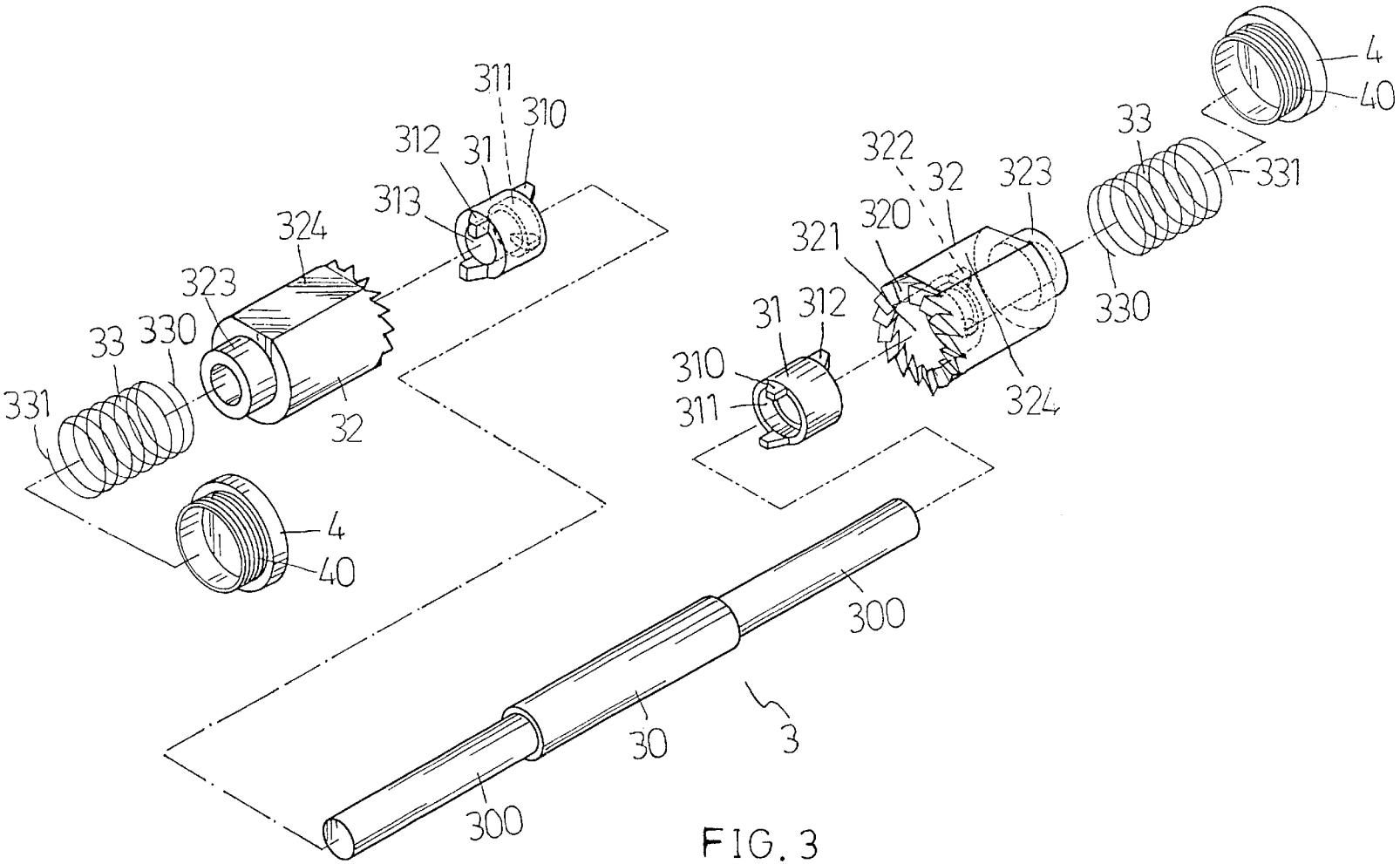
FIG. 3 is an exploded view of the transmission means of the invention.

Refer to FIGS. 1, 2, and 3 for an embodiment of the invention. The invention aims at providing a hinge adopted for use on tables, storage racks and merchandise display shelves that require to be extended and anchored at selected positions when in use and folded when not in use. The hinge of the invention consists of a movable upper leaf 1, a lower leaf 2, a transmission means 3 and a pair of caps 4.

The movable upper leaf 1 includes an upper barrel 10 formed in a middle section thereof with an upper barrel plane 1000 forming on a peripheral side. The upper barrel 10 has a barrel hole 100 formed therein for housing a driving ratchet wheel 11 which has a ratchet plane 113 corresponding to the upper barrel plane 1000. The driving ratchet wheel 11 is fastened to the upper barrel 10 by means of a set screw 101 (or a rivet). The movable upper leaf 1 further has a fastening plate 102 for fastening to a panel 600.

The driving ratchet wheel 11 has two ends each has driving ratchet teeth 110 formed thereon to engage with driven ratchet teeth 320 formed on a lateral end of a driven ratchet wheel 32 housed in a lower barrel 21 of the lower leaf 2. The two ends of the driving ratchet wheel 11 further have respectively an indented trough 111 which has two jutting keys 112 formed on an upper side and a lower side opposing to each other. The ratchet plane 113 is formed on the peripheral surface of the driving ratchet wheel 11 and has a screw hole 1130 formed in the center thereof to couple with and fasten to the upper barrel plane 1000 of the upper barrel 10 at a selected angle to facilitate assembly.

The lower leaf 2 has a center notch 20 and two lower barrels 21 formed at two ends. Each lower barrel 21 has a lower barrel plane 210 formed on an inner top side thereof (when the driving ratchet teeth 110 do not engage with the driven ratchet teeth 320 and the movable upper leaf 1 subjects to a weight on the upper side, the lower barrel plane 210 contacts a driven ratchet plane 324 formed on the driven ratchet wheel 32 to restrict the driven ratchet wheel 32 to move only in a straight line without turning) to contact the driven ratchet plane 324 formed on the peripheral surface of the driven ratchet wheel 32. The lower barrel 21 has a lower barrel center hole 211 which has internal screw threads 2110 formed therein. The lower barrel center hole 211 houses the driven ratchet wheel 32 which has a rotary push element 31 located therein, and the internal screw threads 2110 may engage with external screw threads formed on the cap 4, and the lower leaf 2 may be fastened to a desired wall surface 60.

The transmission means 3 includes a pintle 30 which has two ends forming respectively a pintle stem 300 to couple with the rotary push element 31, driven ratchet wheel 32 and a spring 33. The pintle 30 is housed in the upper barrel 10 of the movable upper leaf 1 and the lower barrels 21 of the lower leaf 2 and has the two ends coupling with the caps 4.

The rotary push element 31 has two retainers 310 located on one lateral side at an upper and a lower position opposing to each other to form a brake relationship with the jutting keys 112 of the driving ratchet wheel 11 during turning. The rotary push element 31 further has an indented recess 311 forming in the lateral side to couple with the pintle 30. The rotary push element 31 has another lateral side opposing to the retainers 310 and having an arched lug 312 to wedge in a wedge slot 322 formed in a housing space 321 in the interior of the driven ratchet teeth 320 of the driven ratchet wheel 32. The rotary push element 31 also has a center hole 313 to allow the pintle stem 300 of the pintle 30 to run through.

The driven ratchet wheel 32 has one end forming the driven ratchet teeth 320 to engage with the driving ratchet teeth 110 on two sides of the driving ratchet wheel 11, and has the wedge slot 322 formed in the interior housing space 321 to engage with the arched lug 312 of the rotary push element 31. The driven ratchet wheel 32 has another end forming a strut 323 to couple with the spring 33 and the driven ratchet plane 324 forming on a top peripheral side to contact an inner side of the lower barrel plane 210 of the lower barrel 21 of the lower leaf 2.

The spring 33 has one end 330 coupling with the strut 323 of the driven ratchet wheel 32 and another end 331 sealed by the cap 4, and is housed in the lower barrel 21 of the lower leaf 2.

Figure 4:
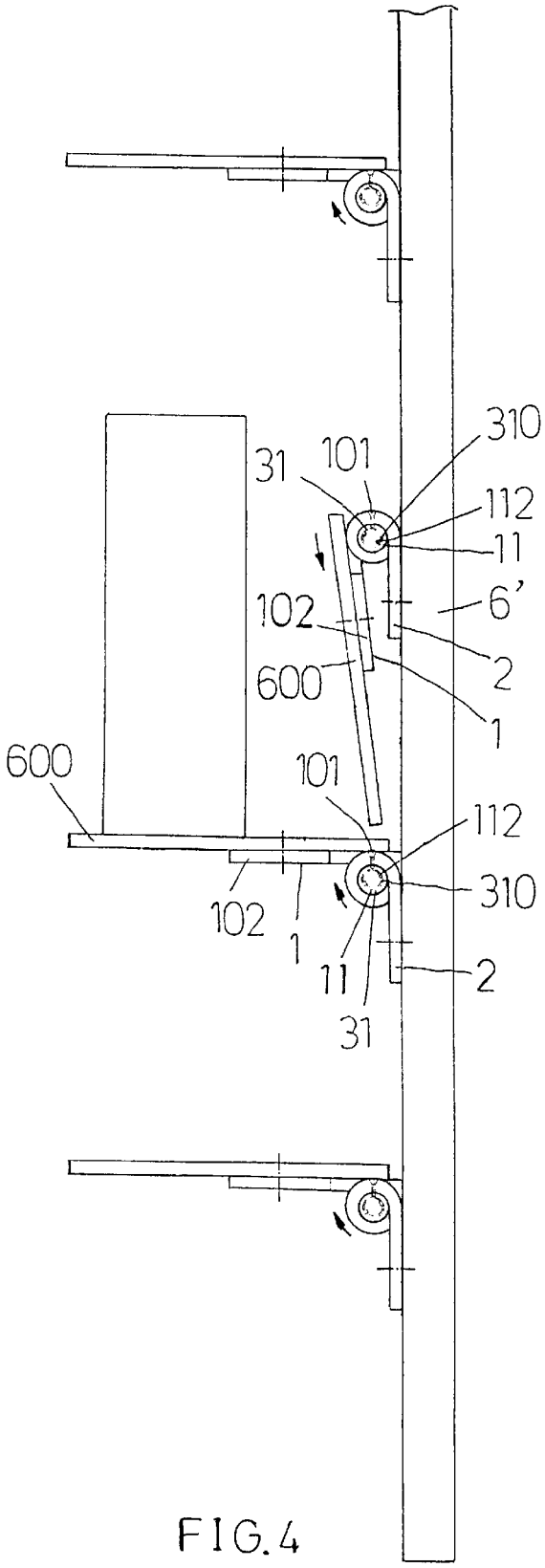
FIG. 4 is a schematic view of the invention in an use condition (fastening to a storage rack or a merchandise shelf).
Figure 5:
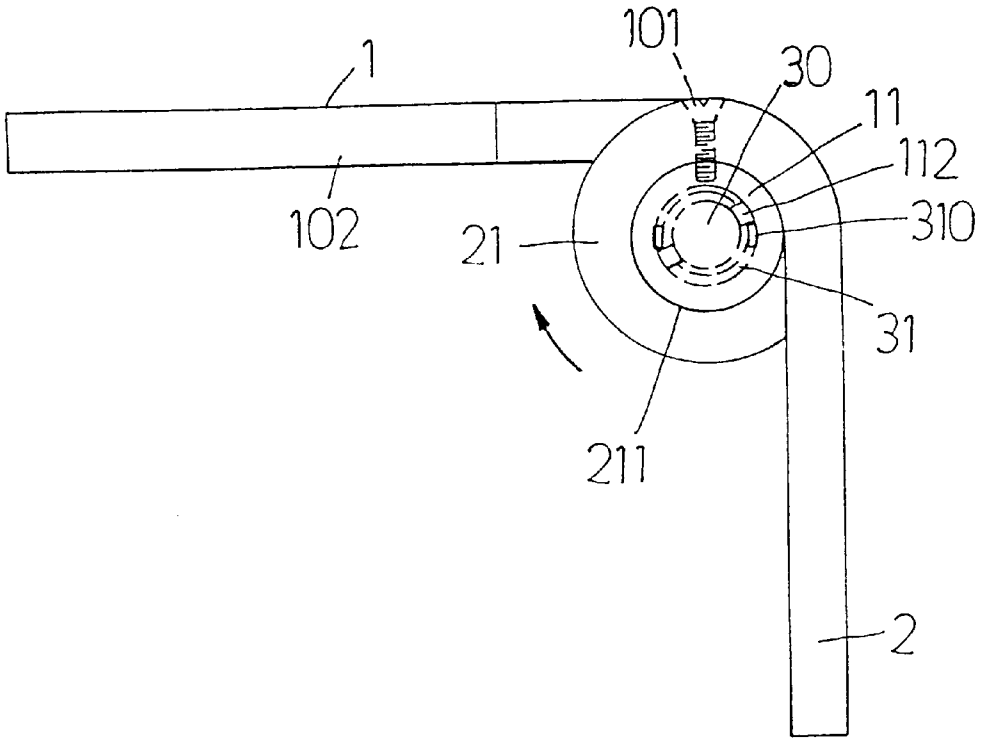
FIG. 5 is a schematic view of the upper leaf of the invention extended to ninety degrees.
Figure 6:
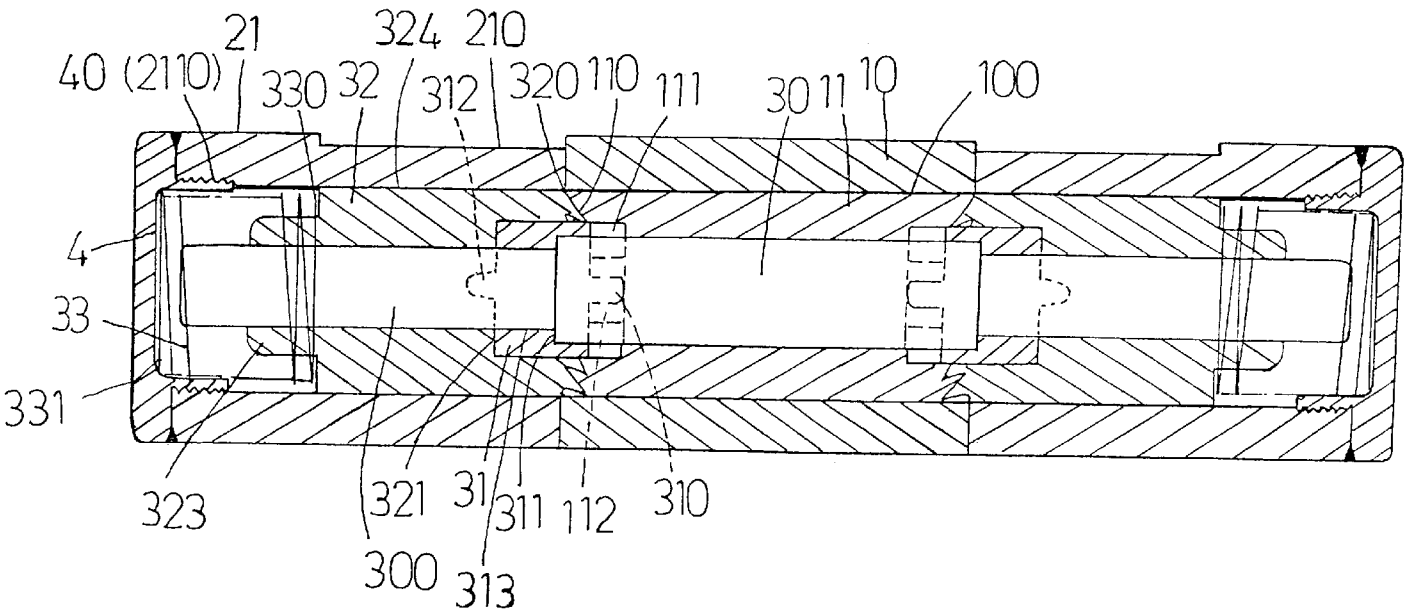
FIG. 6 is a front sectional view according to FIG. 5.
Figure 7:
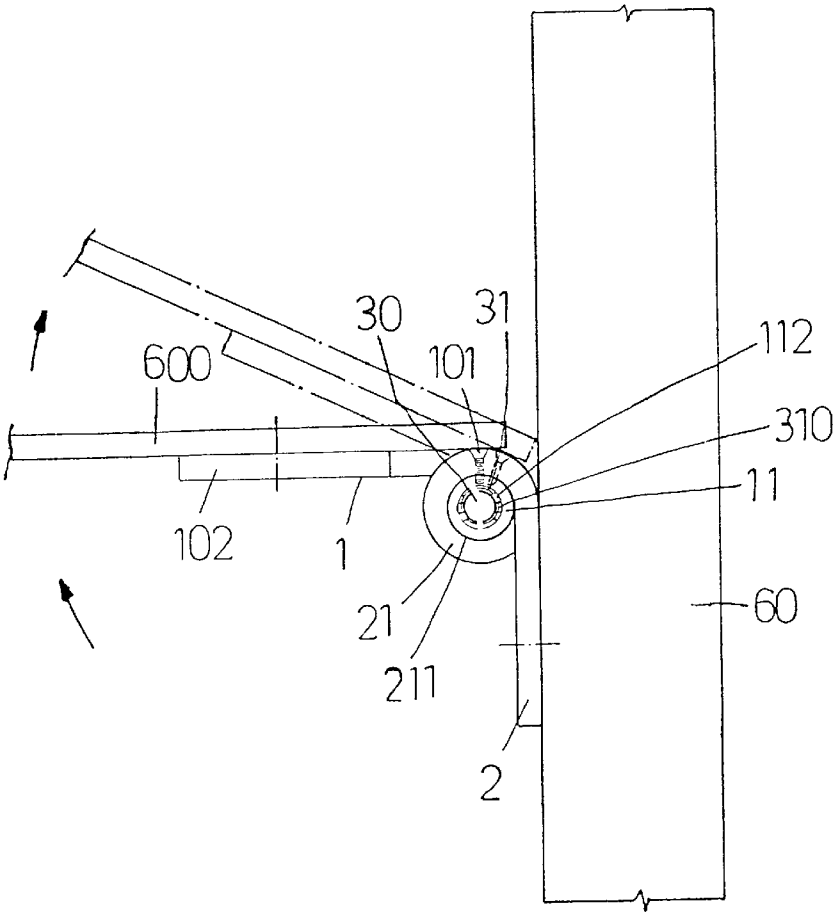
FIG. 7 is a schematic view of the upper leaf of the invention extending to allowable angles (0–120 degrees).
Figure 8:
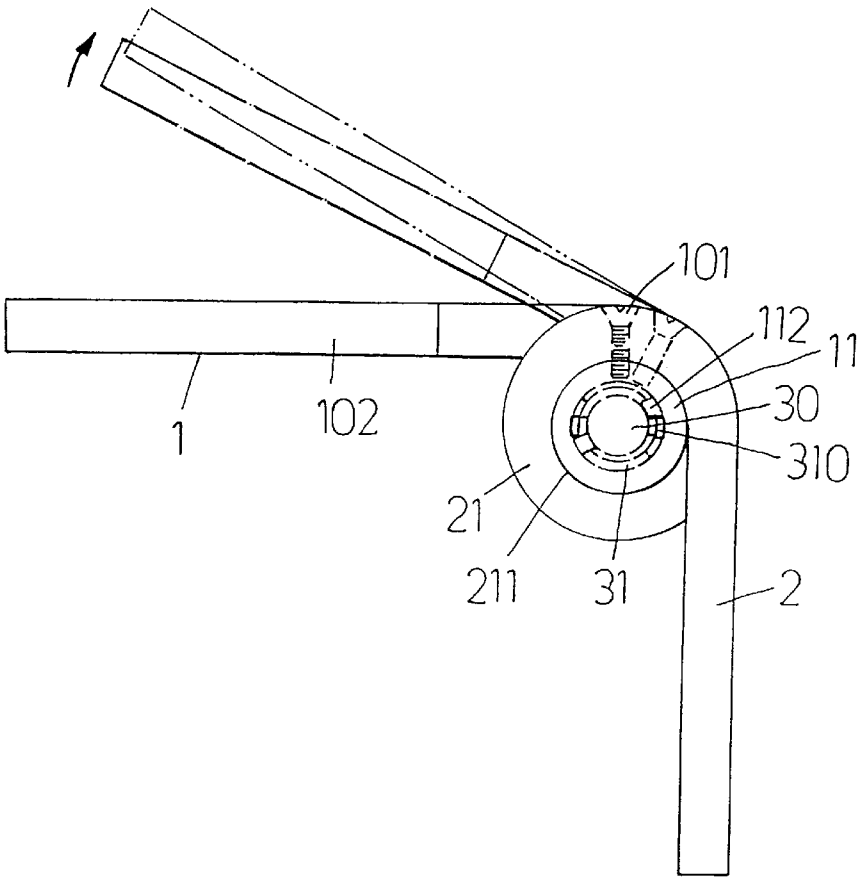
FIG. 8 is a schematic view of the upper leaf of the invention extending beyond the allowable angle (120 degrees).
Figure 9:
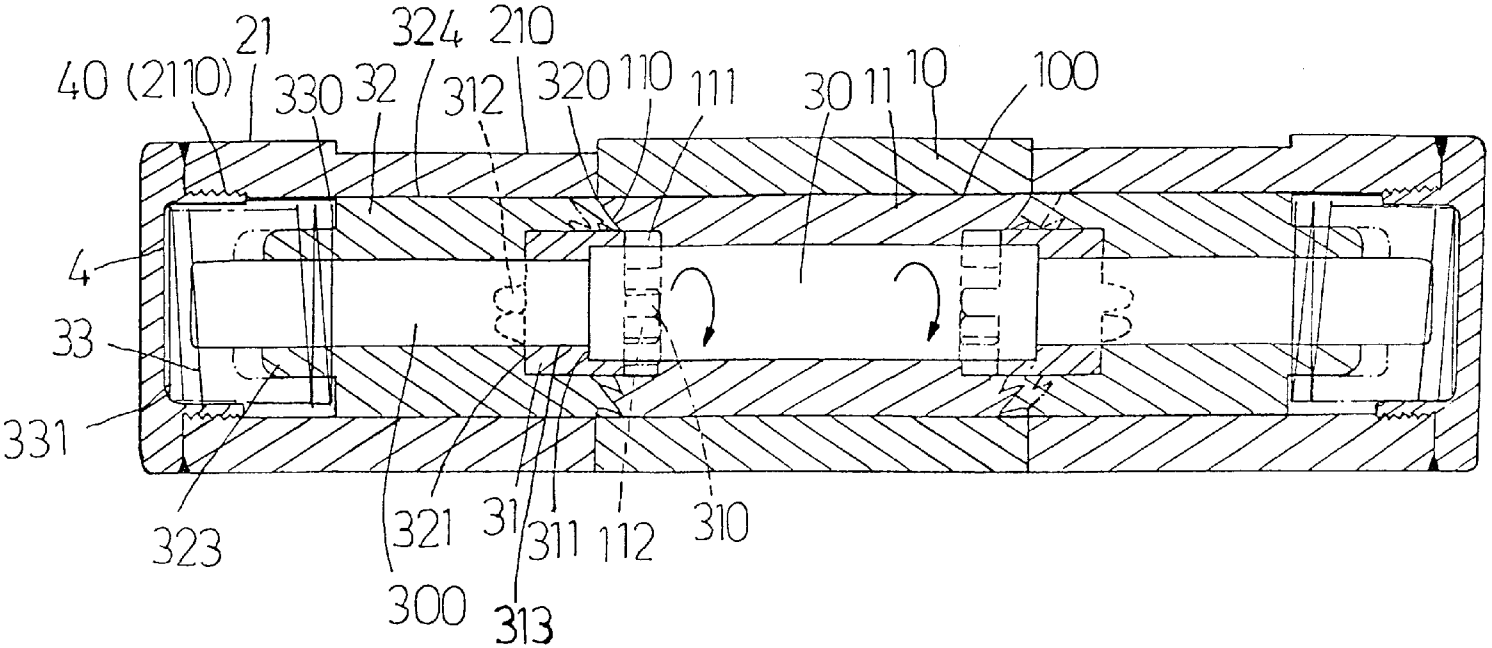
FIG. 9 is a front sectional view according to FIG. 8.
Figure 10:
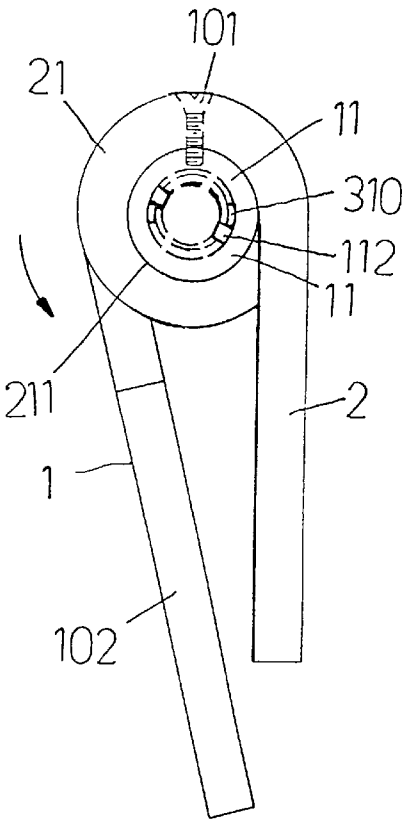
FIG. 10 is a schematic view of the invention in a folding condition.

When in use, as shown in FIG. 4, the movable upper leaf 1 is fastened to a bottom end of an upper panel 600 of a table 6 (or a storage rack, or merchandise shelf 6'), and the lower leaf 2 is fastened to a wall surface 60. When to unfold and extend the upper panel 600, turn the upper panel 600, and the driving ratchet teeth 110 of the driving ratchet wheel 11 housed in the upper barrel 10 of the movable upper leaf 1 engage with the driven ratchet teeth 320 of the driven ratchet wheel 32 housed in the lower barrel 21 of the lower leaf 2, the movable upper leaf 1 attached to the bottom end of the panel 600 may be turned and extended to an use angle (between 0 and 120 degrees, FIG. 5 shows an embodiment with 90 degrees). The jutting keys 112 on two sides of the driving ratchet wheel 11 are moved to hit and are retained by the retainers 310 of the rotary push elements 31 housed in the lower barrels 21 of the lower leaf 2, thus the movable upper leaf 1 and the upper panel 600 are extended and anchored on a desired usable angle (as shown in FIG. 6). When the movable upper leaf 1 is turned and extended beyond the allowable angle (over 120 degrees, as shown in FIGS. 7, 8 and 9), the jutting lugs 112 of the driving ratchet wheel 11 drive the retainers 310 of the rotary push element 31 turning, and the arched lug 312 is moved away from the wedge slot 322, and the driven ratchet wheels 32 are pushed outwards simultaneously in a straight line, and meanwhile the driving ratchet teeth 110 of the driving ratchet wheel 11 and the driven ratchet teeth 320 of the driven ratchet wheel 32 are disengaged (separating), thus the movable upper leaf 1 may be turned and moved back in the reverse direction. Consequently the jutting keys 112 at two ends of the driving ratchet wheel 11 are moved in the reverse direction and drive and move the retainers 310 of the rotary push element 31, and the arched lug 312 on another side of the rotary push element 31 is moved and wedged in the wedge slot 322 of the driven ratchet wheel 32. As a result, the upper panel 600 is latched on the movable upper leaf 1 to form a folding condition (as shown in FIG. 10).

Figure 11:
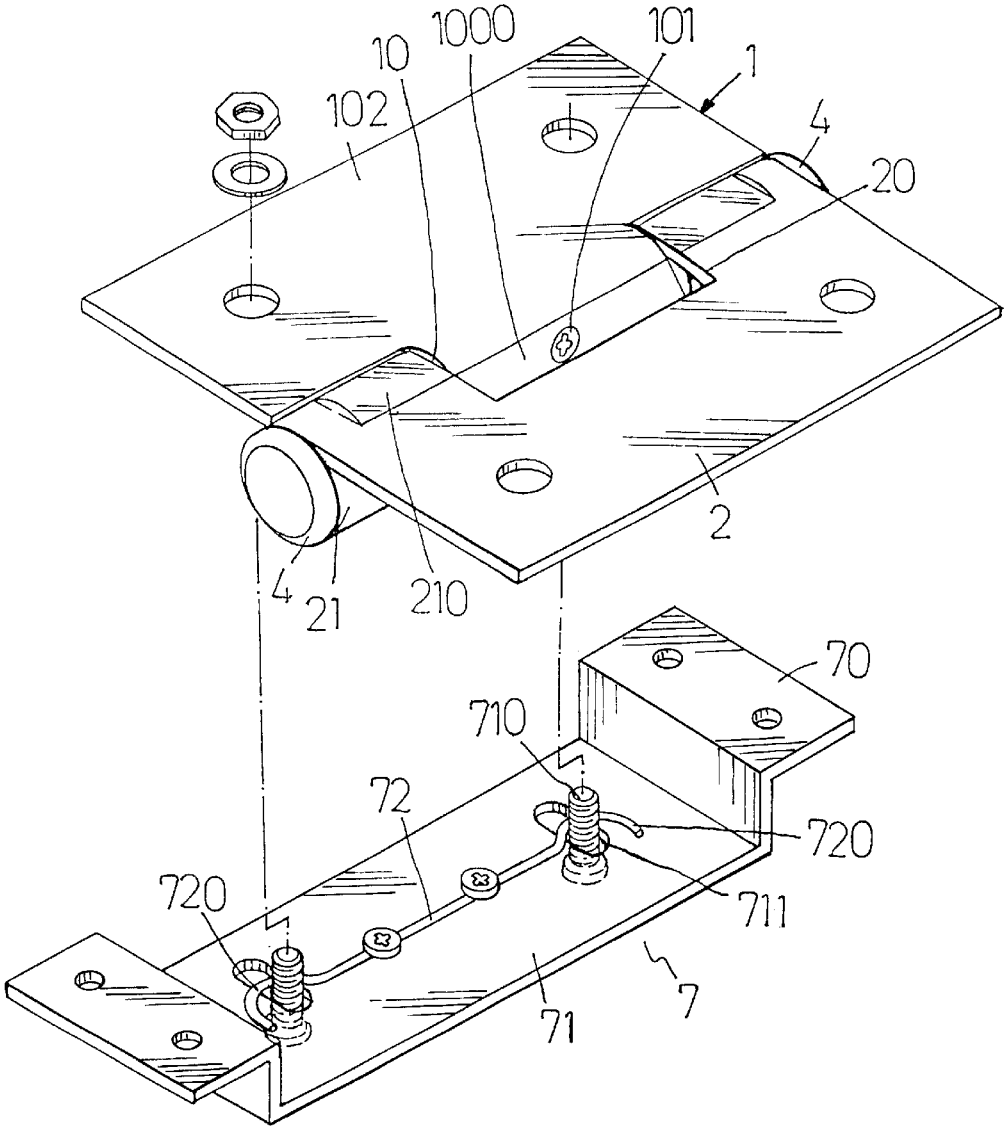
FIG. 11 is an exploded view of the invention coupling with a connection dock.
Figure 12:
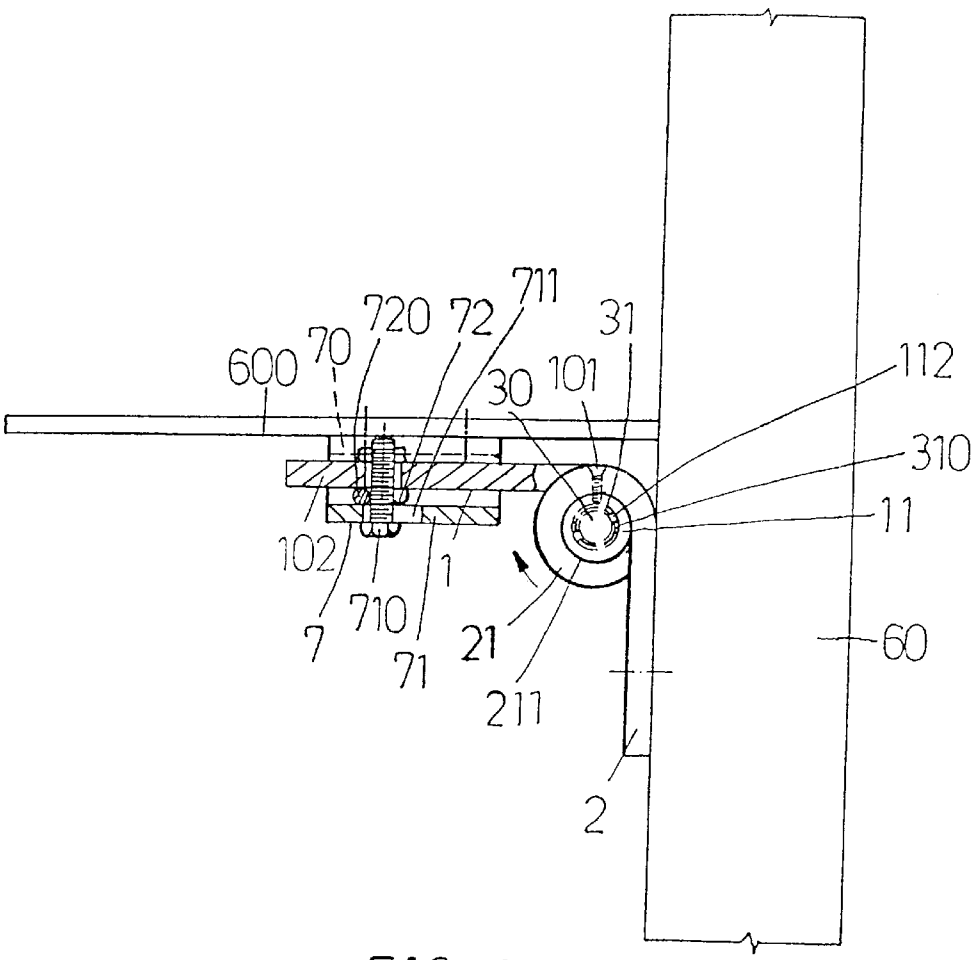
FIG. 12 is a side view of the invention coupling with a connection dock according to FIG. 11.
Figure 13:
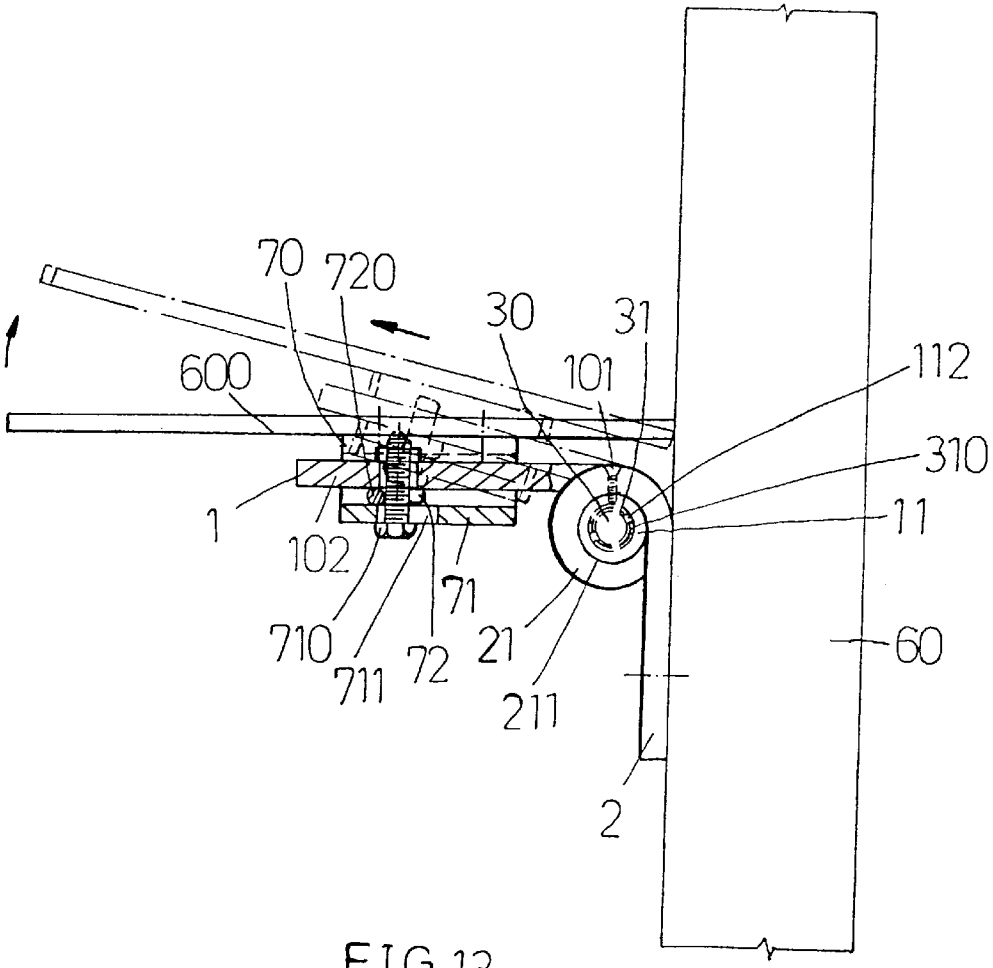
FIG. 13 is a schematic view of the movable upper leaf of the invention in an use condition according to FIG. 11.

Refer to FIGS. 11 and 12 for another embodiment of the invention that couples with a connection dock. The lower side of the movable upper leaf 1 is fastened to a connection dock 7. The connection dock 7 has two flanges 70 at two ends for fastening to a panel 600 of table 6 or a storage rack or merchandise shelf 6' which is fastened to a wall surface 60. The connection dock 7 has a bridge plate 71 which has two slots 711 formed on two sides for coupling with screws 710. There is a fastening spring 72 located above the bridge plate 71 that has two arched ends 720 to engage with the rear ends of the screws 710. By means of the elasticity of the spring 72, when the panel 600 fastened to the upper leaf 1 is extended more than 90 degrees, the panel 600 hits the wall surface 60 and is pushed forwards, therefore the panel 600 may constantly contact the wall surface 60 (as shown in FIG. 13) without forming a gap with the wall surface 60, thus form a neat appearance.

What is claimed is:

1. A hinge comprising a movable upper leaf, a driving ratchet wheel, a lower leaf, a transmission means and a pair of caps, wherein:

the movable upper leaf includes an upper barrel formed in a middle section thereof and a fastening plate extending outwards, the upper barrel having an upper barrel plane formed on a peripheral surface thereof and a barrel hole formed therein for housing the driving ratchet wheel which has a ratchet plane corresponding to the upper barrel plane;

the driving ratchet wheel has two ends each having driving ratchet teeth formed thereon and an indented trough formed therein which has two jutting keys located on an upper side and a lower side thereof opposing to each other, the ratchet plane being formed on the peripheral surface of the driving ratchet wheel and having a screw hole formed in the center thereof to couple with and fasten to the upper barrel plane of the movable upper leaf at a selected angle;

the lower leaf has a center notch and two lower barrels formed at two ends thereof, each lower barrel having a lower barrel plane formed on an inner top side thereof and a lower barrel center hole which has internal screw threads formed therein to engage with external screw threads formed on the cap; and the transmission means is housed in the upper barrel of the movable upper leaf and the lower barrels of the lower leaf includes a pintle which has two ends forming respectively a pintle stem to couple with a rotary push element, a driven ratchet wheel and a spring, wherein:

the rotary push element has two retainers located on one lateral side thereof at an upper and a lower position opposing to each other to form a brake relationship with the jutting keys of the driving ratchet wheel during turning, and an indented recess formed in the one lateral side for housing the pintle, and an arched lug located on another lateral side thereof to wedge in a wedge slot formed in a housing space in the interior of driven ratchet teeth formed on one end of the driven ratchet wheel, and a center hole to allow the pintle stem of the pintle to run through;

the driven ratchet wheel has the driven ratchet teeth engaging with the driving ratchet teeth of the driving ratchet wheel, and the wedge slot engaging with the arched lug of the rotary push element, and has one end forming a strut to couple with the spring and a driven ratchet plane formed on a top peripheral side thereof to contact the lower barrel plane of the lower barrel of the lower leaf; and the spring is housed in the lower barrel of the lower leaf and has one end coupling with the strut of the driven ratchet wheel and another end sealed by the cap;

wherein when the hinge is installed the movable upper leaf is fastened to a bottom end of an upper panel and the lower leaf is fastened to a wall surface, the driving ratchet teeth of the driving ratchet wheel housed in the upper barrel of the upper leaf engage with the driven ratchet teeth of the driven ratchet wheel housed in the lower barrel of the lower leaf to allow the upper panel attached to the upper leaf to be turned and extended to a selected angle between 0 and 120 degrees for use, and the jutting keys on two sides of the driving ratchet wheel hit and are retained by the retainers of the rotary push element housed in the lower barrel of the lower leaf to anchor the movable upper leaf on an use angle;

wherein when the movable upper leaf is extended exceeding an allowable using angle, the jutting keys of the driving ratchet wheel drive the retainers of the rotary push element turning, and the arched lug is moved away from the wedge slot, and the driven ratchet wheels are pushed outwards simultaneously in a straight line, and the driving ratchet teeth of the driving ratchet wheel and the driven ratchet teeth of the driven ratchet wheels are disengaged to allow the movable upper leaf to be turned and moved back in a reverse direction, and the jutting keys at two ends of the driving ratchet wheel are moved in the reverse direction and drive and move the retainers of the rotary push element, and the arched lug on another side of the rotary push element is moved and wedged in the wedge slot of the driven ratchet wheel for moving the upper panel fastened to the movable upper leaf to a folding position.

* * * * *